US006871843B2

(12) United States Patent
Abei et al.

(10) Patent No.: US 6,871,843 B2
(45) Date of Patent: Mar. 29, 2005

(54) CARBURETOR WITH IDLE FUEL SUPPLY ARRANGEMENT

(75) Inventors: Takashi Abei, Miyagi-ken (JP); Hidenori Sasaki, Miyagi-ken (JP); Masao Suzuki, Miyagi-ken (JP)

(73) Assignee: Walbro Japan, Inc., Tokyo (JP)

( * ) Notice: Subject to any disclaimer, the term of this patent is extended or adjusted under 35 U.S.C. 154(b) by 60 days.

(21) Appl. No.: 10/383,804

(22) Filed: Mar. 7, 2003

(65) Prior Publication Data

US 2003/0168753 A1 Sep. 11, 2003

(30) Foreign Application Priority Data

Mar. 8, 2002 (JP) ..... 2002-062856

(51) Int. Cl.[7] ..... F02M 3/06

(52) U.S. Cl. ..... 261/41.5; 261/63; 261/121.3; 261/DIG. 21; 261/DIG. 55

(58) Field of Search ..... 261/41.5, 63, 78.1, 261/121.3, DIG. 55, DIG. 21

(56) References Cited

U.S. PATENT DOCUMENTS

| | | | | | |
|---|---|---|---|---|---|
| 2,795,494 | A | * | 6/1957 | Ensign | 48/184 |
| 2,889,820 | A | * | 6/1959 | Grozinger | 123/587 |
| 3,215,413 | A | * | 11/1965 | Szwargulski et al. | 261/41.5 |
| 3,319,944 | A | * | 5/1967 | Brenneman | 261/41.5 |
| 3,608,874 | A | | 9/1971 | Beckmann | 261/41.5 |
| 3,931,372 | A | | 1/1976 | Pierlot | 261/41.5 |
| 3,943,899 | A | * | 3/1976 | Matsuoka et al. | 123/585 |
| 4,217,313 | A | * | 8/1980 | Dmitrievsky et al. | 261/41.5 |
| 4,269,062 | A | * | 5/1981 | Smitley | 73/118.1 |
| 4,401,074 | A | * | 8/1983 | Horiuchi et al. | 123/339.13 |
| 4,712,531 | A | * | 12/1987 | Ishizawa et al. | 123/556 |
| 4,931,226 | A | | 6/1990 | Ishii | 261/41.5 |
| 5,002,705 | A | | 3/1991 | Kohler | 261/35 |
| 6,000,369 | A | | 12/1999 | Koizumi | 123/179.16 |
| 6,059,271 | A | | 5/2000 | Gerhardy | 261/35 |

FOREIGN PATENT DOCUMENTS

| | | | | |
|---|---|---|---|---|
| JP | 54-116523 | * | 9/1979 | 261/41.5 |

* cited by examiner

*Primary Examiner*—Richard L. Chiesa
(74) *Attorney, Agent, or Firm*—Reising, Ethington, Barnes, Kisselle, P.C.

(57) ABSTRACT

An idle fuel supply device for a carburetor has an idle air passage that communicates with an air intake passage and a fuel chamber. A passage extending from a fuel metering chamber is connected to the fuel chamber preferably via a fuel adjusting needle valve. A low speed fuel nozzle hole communicates the fuel chamber with the air intake passage in the vicinity of a throttle valve when in its idle position. A passage communicates with the fuel chamber and the idle air passage, so that fuel and air may mix in at least a portion of the idle air passage.

16 Claims, 6 Drawing Sheets

CARBURETOR WITH IDLE FUEL SUPPLY ARRANGEMENT

FIELD OF THE INVENTION

The present invention relates generally to a carburetor and more particularly to a carburetor having a butterfly type throttle valve.

BACKGROUND OF THE INVENTION

As shown in FIG. 10, in a conventional diaphragm type carburetor, a constant pressure fuel supply mechanism B having a fuel metering chamber 13 defined by a diaphragm 9 is provided in the lower part of a carburetor body 32. A passage 2 is communicated with the fuel metering chamber 13 and with a fuel chamber 27 via a fuel adjusting needle valve 31. A plurality of low speed fuel nozzle holes 28 open into an air intake passage 30 upstream of a throttle valve 24 when it is in its idle position, and a single pilot hole 28*a* opens to the air intake passage 30 on the downstream side of the throttle valve 24. Further, a high speed fuel nozzle hole 29 is open to a venturi portion 30*a* of the air intake passage 30 and communicates with the fuel metering chamber 13 via a fuel jet 5, a passage 3, and a check valve 29*a*.

In the above-described diaphragm type carburetor, fuel in the fuel metering chamber 13 is directly taken into the air intake passage 30 from the pilot fuel nozzle holes 28*a*. Fuel is not always sufficiently mixed with air in the air intake passage 30, and particularly during idle operation of the engine, fuel from the low speed fuel nozzle hole 28 may collect on the throttle valve 24 to the inner peripheral wall of the air intake passage 30, and the mixture of fuel and air is not always supplied to the engine in a stabilized manner. Particularly, when fuel that had collected on the inner wall of the air intake passage 30 suddenly enters the airflow through the air intake passage 30 due, for example, to the tilting of the carburetor body, a richer than desired fuel and air mixture is supplied to the engine momentarily, and may adversely affect idle operation of the engine. In extreme cases, the fuel and air mixture may be so rich that the engine stalls, and immediate re-starting of the engine may be difficult.

The carburetor as shown in FIG. 11, can have the same problem. As shown in FIG. 11, the fuel metering chamber 13 is communicated with the fuel chamber 27 via a fuel jet 4. The passage 2, in the idle running of the engine, is taken into a chamber 27 on the upstream side of the throttle valve 24 via the low speed fuel nozzle holes 28. Simultaneously, the fuel in the fuel chamber 27 is fed to a pilot passage 28*a* (via a fuel adjusting needle valve 31) which opens into the air intake passage downstream of the throttle valve 24 in its idle position. Fuel taken from the low speed fuel nozzle holes 28 and the pilot passage 28*a* is to be mixed with air in the air intake passage 30, and may not obtain sufficient atomization of fuel.

Further, in the conventional float type carburetor, as shown in FIG. 12, an air passage 42 substantially parallel to the air intake passage 30 and having a first end communicated with the air intake passage 30 is provided in carburetor body 32. A low speed fuel supply pipe 47 extending from a float chamber 57 is connected to the air passage 42 by low speed fuel nozzle holes 28 open to a fuel chamber 27 and to the air intake passage 30 upstream of a throttle valve 24 when in its idle position. The other end of the air passage 42 is connected to a valve chamber 34 of a fuel adjusting needle valve 31, and a pilot fuel nozzle hole 28*a* is open to the air intake passage 30 downstream of the throttle valve 24 when in its idle position. In the above-described float type carburetor, since fuel from the low speed fuel supply pipe 47 is mixed with air during fuel flows to the low speed fuel nozzle holes 28 and the pilot fuel nozzle hole 28*a*, atomization of fuel is accelerated as compared with that shown in FIGS. 10 and 11, but since the air flow in the air passage 42 is weak, atomization of fuel may not be sufficient.

SUMMARY OF THE INVENTION

An idle fuel supply device for a carburetor has an idle air passage that communicates with an air intake passage and a fuel chamber. A passage extending from a fuel metering chamber is connected to the fuel chamber preferably via a fuel adjusting needle valve. A low speed fuel nozzle hole communicates the fuel chamber with the air intake passage in the vicinity of a throttle valve when in its idle position. A passage communicates with the fuel chamber and the idle air passage, so that fuel and air may mix in at least a portion of the idle air passage.

According to one presently preferred embodiment of a carburetor, a fuel jet is provided in the passage communicating the fuel metering chamber with the fuel chamber, and a fuel adjusting needle valve is provided in the passage communicating the fuel chamber and the idle air passage. The needle valve may have a valve chamber that communicates with the idle air passage. According to other embodiments, the invention may also be employed in float-type carburetors.

BRIEF DESCRIPTION OF THE DRAWINGS

These and other objects, features and advantages of the present invention will be apparent from the following detailed description of the preferred embodiments, appended claims and accompanying drawings in which:

DETAILED DESCRIPTION OF THE PREFERRED EMBODIMENTS

Figure 1:
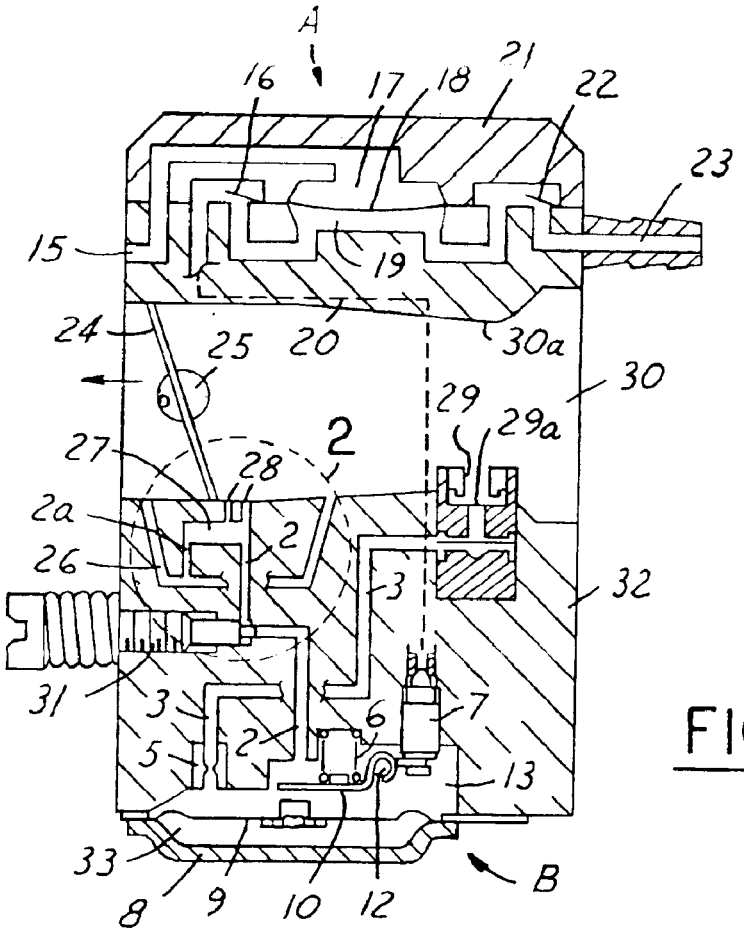
FIG. 1 is a side sectional view, showing an idle fuel supply device for a diaphragm type carburetor according to a first embodiment of the present invention.
Figure 2:
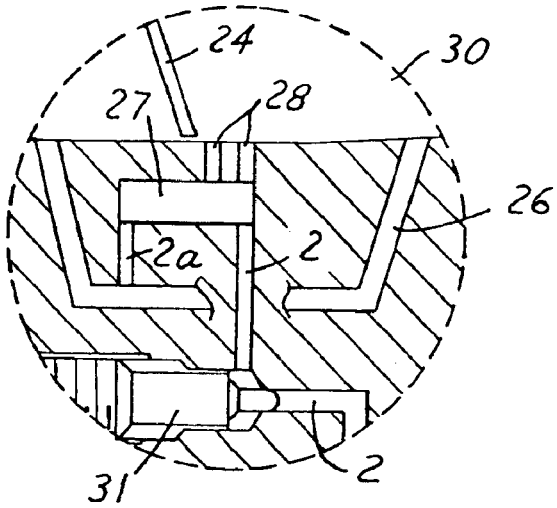
FIG. 2 is an enlarged fragmentary sectional view showing a portion encircled by a circle in FIG. 1.

As shown in FIGS. 1 and 2, a fuel pump diaphragm 18 is disposed between a cover plate 21 and the upper wall surface of a carburetor body 32 through which an air intake passage 30 extends. A fuel pump A comprises a pulsation pressure chamber 17 for introducing pulsation pressure from a crank chamber of the engine through an inlet 15 which is formed on one side of the diaphragm 18, and a pump chamber 19 formed on the other side of the diaphragm 18. With the vertical displacement of the diaphragm 18 of the fuel pump A, fuel in a fuel tank, not shown, is taken into the pump chamber 19 via a fuel inlet 23 and a pump inlet valve 22, and is further supplied to a fuel metering chamber 18 of a fuel metering assembly B via an outlet valve 16, a passage 20 and an inlet valve 7.

Figure 10:
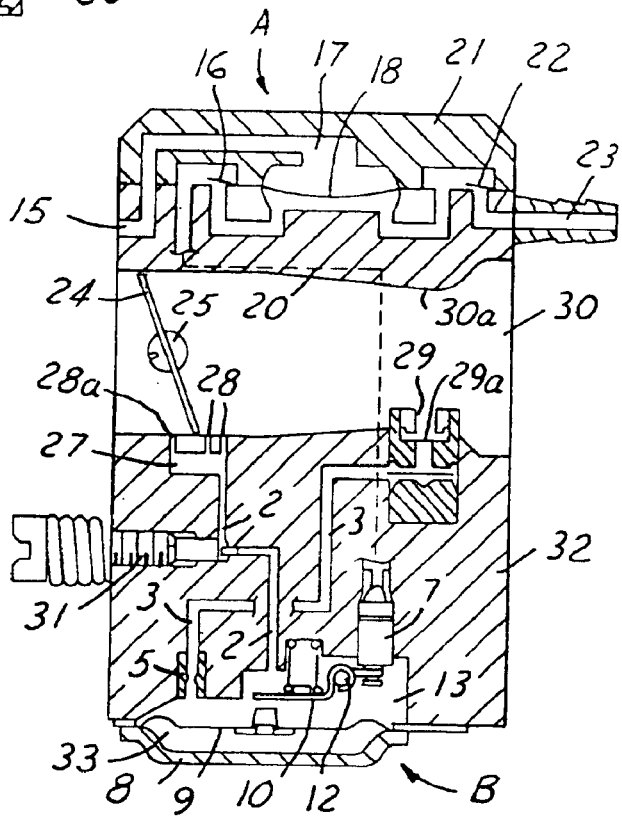
(PRIOR ART) FIG. 10
FIG. 10 is a side sectional view of a conventional diaphragm type carburetor.
Figure 11:
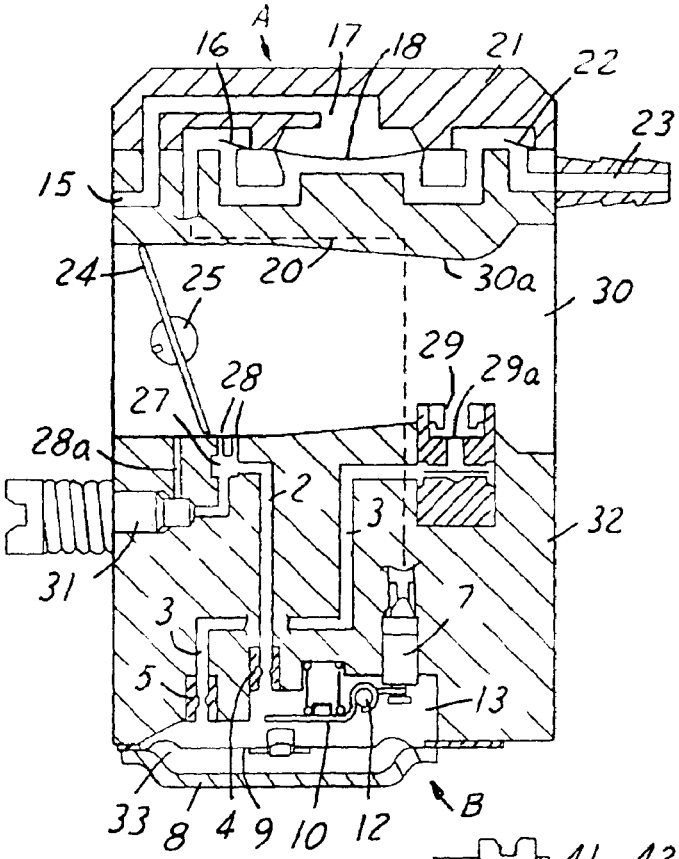
(PRIOR ART) FIG. 11
FIG. 11 is a side sectional view of a conventional diaphragm type carburetor.
Figure 12:
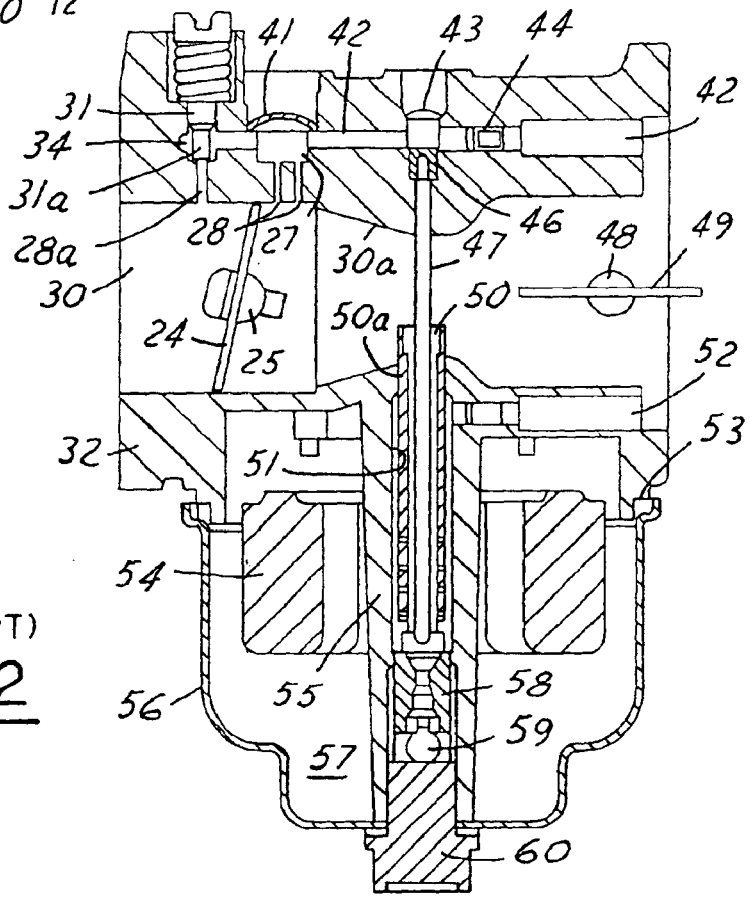
(PRIOR ART) FIG. 12
FIG. 12 is a side sectional view of a conventional float type carburetor.

In the fuel metering assembly B, a cover plate 8 and a fuel metering diaphragm 9 are connected to the carburetor body 32, and the fuel metering chamber 13 and an atmospheric chamber 33 are formed on the opposed sides of the diaphragm 9. One end of a lever 10 pivotally supported by a shaft 12 is yieldably biased into engagement with a center protrusion of the diaphragm 9 by a force of a spring 6 while the other end of the lever 10 is engaged with the lower end of the inlet valve 7. When the volume of fuel in the fuel metering chamber 13 reduces, the resultant force of intake pressure exerted on the fuel metering chamber side of the diaphragm 9 becomes greater than the force of the spring 6, the lever 10 is pivoted or rotated to open the inlet valve 7, and fuel is supplied from the fuel pump A to the fuel metering chamber 13. The fuel pump A and fuel metering assembly B and their components may be of conventional construction, and are also shown in FIGS. 10 and 11.

A fuel chamber 27 is provided in the carburetor body 32, preferably adjacent to a throttle valve 24 disposed in the air intake passage 30 on a valve shaft 25. A passage 2 communicates with the fuel metering chamber 13 and the fuel chamber 27 via a fuel adjusting needle valve 31. A plurality of low speed fuel nozzle holes 28 communicate with the fuel chamber 27 and the air intake passage 30 upstream of the throttle valve 24 when the throttle valve is in its idle position. Further, the fuel metering chamber 13 is connected to a high speed fuel nozzle hole 29 opened to a venturi portion 30*a* of the air intake passage 30 via a fuel jet 5, a passage 3 and a check valve 29*a*.

To supply atomized fuel during idle operation of the engine, an idle air passage 26 is provided in communication with the air intake passage and with the fuel chamber 27. Preferably, the idle air passage 26 is open to the air intake passage 30 upstream of the throttle valve at one end, and downstream of the throttle valve at its other end, at least when the throttle valve is in its idle position. A passage 2*a* extending from the fuel chamber 27 is connected to the idle air passage 26 preferably between the ends of the idle air passage 26.

With this arrangement, an air flow moving from the upstream end toward the downstream end of the air intake passage 30 is generated in the idle air passage 26 due to a pressure difference between the upstream end and the downstream end during idle operation of the engine. Accordingly, fuel in the fuel chamber 27 is taken into the idle air passage 26, is mixed with air or atomized in the idle air passage 26 and is taken into the air intake passage 30. Thus, a mixture for which atomization is accelerated in the idle air passage 26 is taken into the air intake passage 30, and therefore fuel does not collect on the peripheral wall of the air intake passage 30, and the mixture is supplied to the engine in a stable and continuous flow, thereby improving steady idle engine operation.

Figure 3:
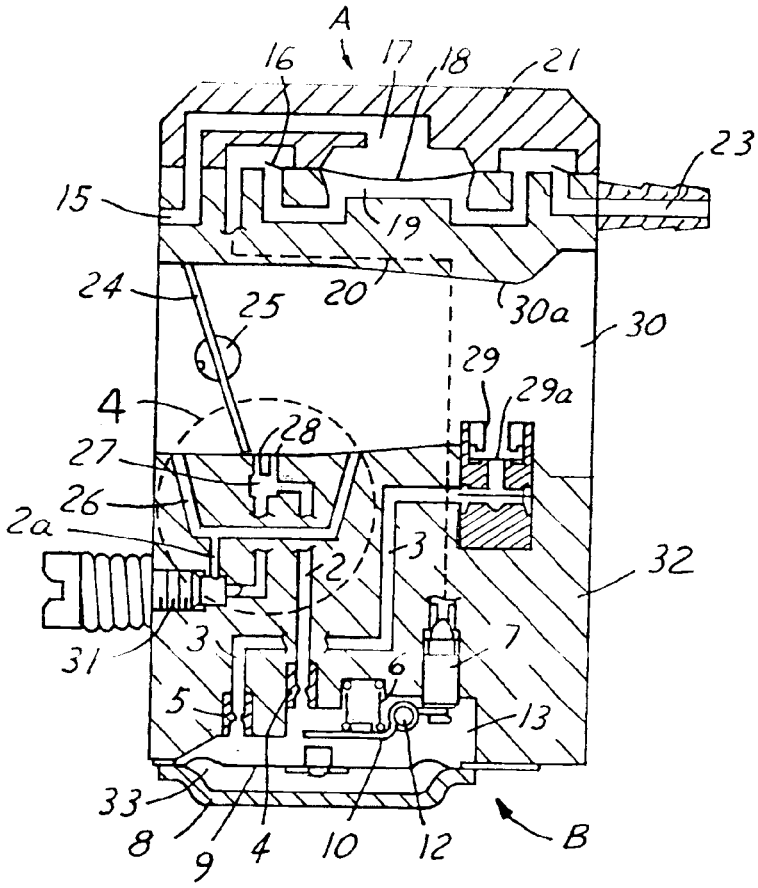
FIG. 3 is a side sectional view, with hatching omitted, showing an idle fuel supply device for a diaphragm type carburetor according to a second embodiment of the present invention.
Figure 4:
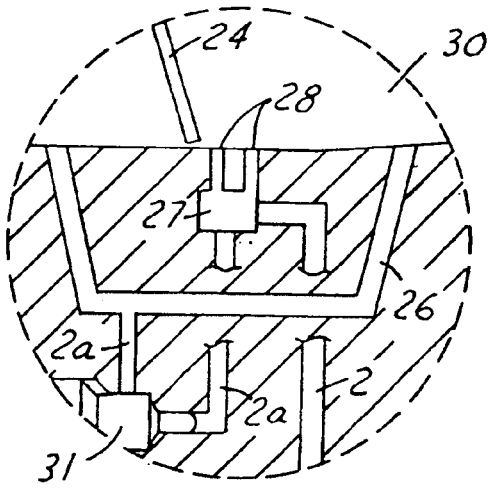
FIG. 4 is an enlarged fragmentary sectional view showing a portion encircled by a circle in FIG. 3.
Figure 5:
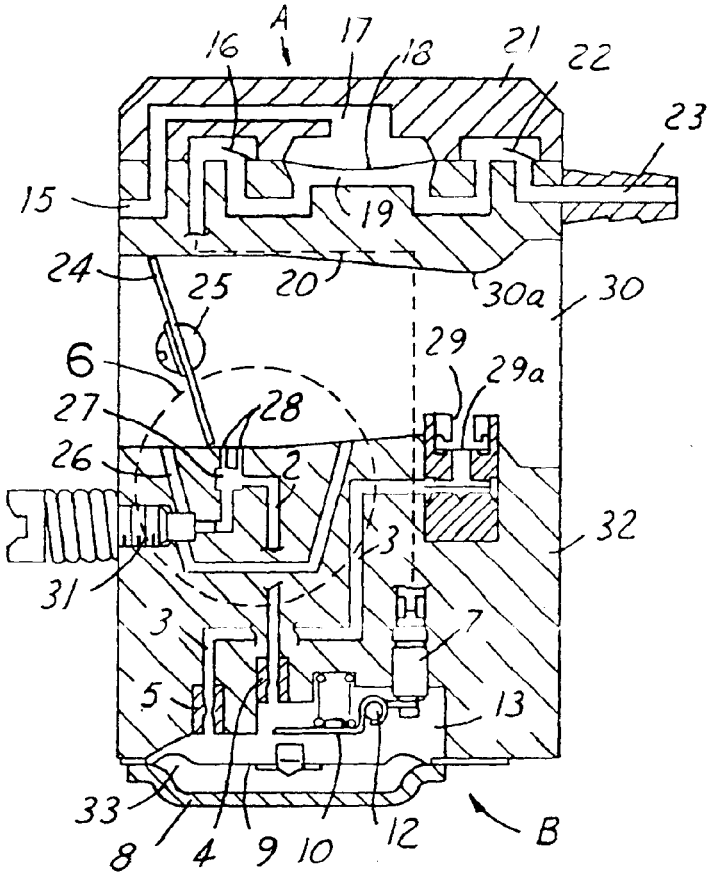
FIG. 5 is a side sectional view, with hatching omitted, showing an idle fuel supply device for a diaphragm type carburetor according to a third embodiment of the present invention.
Figure 6:
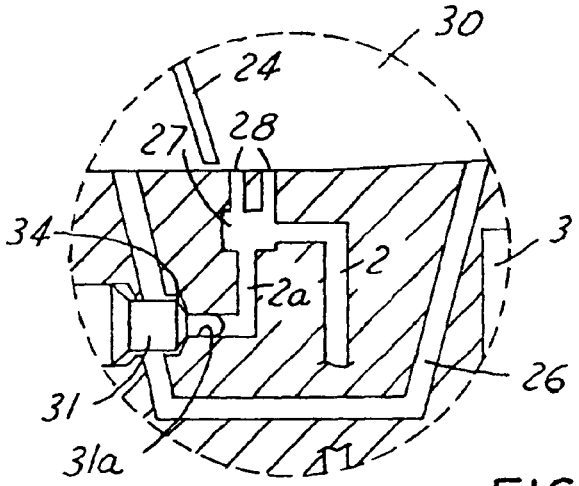
FIG. 6 is an enlargement fragmentary sectional view showing a portion encircled by a circle in FIG. 5.

While in the embodiment shown in FIGS. 1 and 2, the quantity of fuel flowing form the fuel metering chamber 13 to the fuel chamber 27 is regulated by the fuel adjusting needle valve 31, it is noted alternatively that, as shown in FIGS. 3 and 4, the fuel metering chamber 13 and the fuel chamber 27 may be connected by the passage 2 having a restriction or fuel jet 4. The fuel adjusting needle valve 31 may be provided in the passage 2*a* extending form the fuel chamber 27 to the idle air passage 26. Further, as shown in FIGS. 5 and 6, the valve chamber 34 of the fuel adjusting needle valve 31 is connected to the idle air passage 26. The passage 2*a* extending from the fuel chamber 27 is connected to a passage 31*a* surrounding an end needle of the fuel adjusting needle valve 31, and the quantity of fuel flowing from the fuel chamber 27 to the idle air passage 26 can be controlled.

Figure 7:
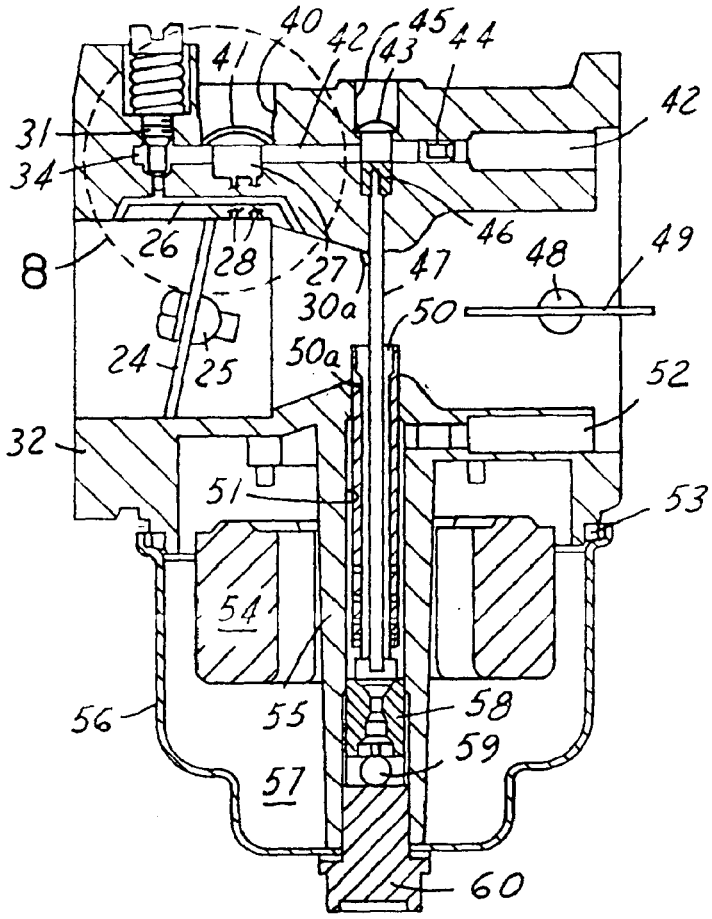
FIG. 7 is a side sectional view, with hatching omitted, showing an idle fuel supply device for a float type carburetor according to a fourth embodiment of the present invention.
Figure 8:
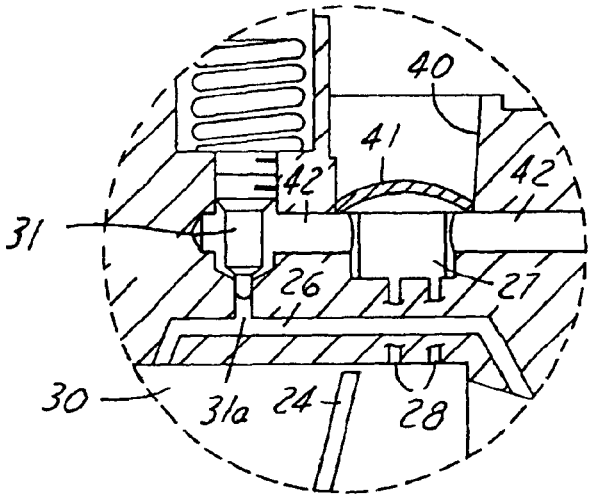
FIG. 8 is an enlarged fragmentary sectional view showing a portion encircled by a circle in FIG. 7.

The embodiment shown in FIGS. 7 and 8 relates to an idle fuel supply device for a float type carburetor. An air passage 42 is provided substantially parallel to the air intake passage 30 and has a first end open to an inlet portion of the air intake passage 30. An air jet 44, a fuel jet 46 at the end of a low speed fuel supply pipe 47, and the fuel chamber 27 are disposed in the air passage 42. The other end of the air passage 42 is connected to a valve chamber 34 of the fuel adjusting needle valve 31. The upper end of the low speed fuel supply pipe 47 is connected to a cylindrical bore 45 crossing the air passage 42. The fuel jet 46 is fitted into the cylindrical bore 45, and further the upper end of the cylindrical bore 45 is closed by a plug 43. Similarly, the fuel chamber 27 is also formed as a cylindrical bore 40 crossing the air passage 42, and the upper end of the cylindrical bore 40 is closed by a plug 41.

A plurality of low speed fuel nozzle holes 28 communicate the fuel chamber 27 with the air intake passage 30 upstream of the throttle valve 24 when the throttle valve 24 is in its idle position. The passage 31*a* surrounding the needle end of the fuel adjusting needle valve 31 is connected to the idle air passage 26.

A fuel reservoir 56 is fastened by a bolt 60 to the lower end of a column 55 projecting downward form the bottom of the carburetor body 32. The upper end peripheral portion of the fuel reservoir 56 is closely mounted on the bottom of the carburetor body 32 through a seal member 53. A well known horseshoe-shaped float 54 is enclosed inside the fuel reservoir 56, that is, in a float chamber 57. An inlet valve, not shown, is opened and closed due to the vertical movement of the float 54, and fuel is suitably replenished to the float chamber 57. A cylindrical bore 51 as an extending portion of a tapped hole engaging with the bolt 60 is provided on the column 55, an inlet 59 in communication with the float chamber 57 is provided on part of the bore 51, and a fuel jet 58 and a high speed fuel supply pipe 50*a* are fitted. The fuel supply pipe has a vacant portion relative to the bore 51, and an air passage 52 opened to the inlet of the air intake passage 30 is connected to the bore 51.

Air in the bore 51 enters into the high speed fuel supply pipe 50*a* through a plurality of through-holes provided in the peripheral wall of the high speed fuel supply pipe 50*a*, is mixed with fuel flowing into the high speed fuel supply pipe 50*a* via the fuel jet 58, and is taken into a venturi portion 30*a* of the air intake passage 30 from a high speed fuel nozzle hole 50. On the other hand, fuel in the high speed fuel supply pipe 50*a* flows into the air passage 42 through the low speed fuel supply pipe 47 and the fuel jet 46, and is supplied to the air intake passage 30 upstream of the throttle valve 24 via the fuel chamber 27, while mixing with air in the air passage 42, and the low speed fuel nozzle holes 28. Further, the fuel and air mixture in the fuel chamber 27 is supplied to the air intake passage 30 downstream of the throttle valve 24 via the fuel adjusting needle valve 31, the passage 31*a* and the idle air passage 26. When forming the idle air passage 26 in the arrangement shown, the idle air passage 26 is extended to the end wall of the carburetor body 32, and the end of the idle air passage 26 is closed by a plug. A portion of the idle air passage 26 extending obliquely to the air intake passage 30 is formed from the peripheral wall of the air intake passage 30. Preferably, a choke valve 49 is supported by a valve shaft 48 at the inlet portion of the air intake passage 30.

Figure 9:
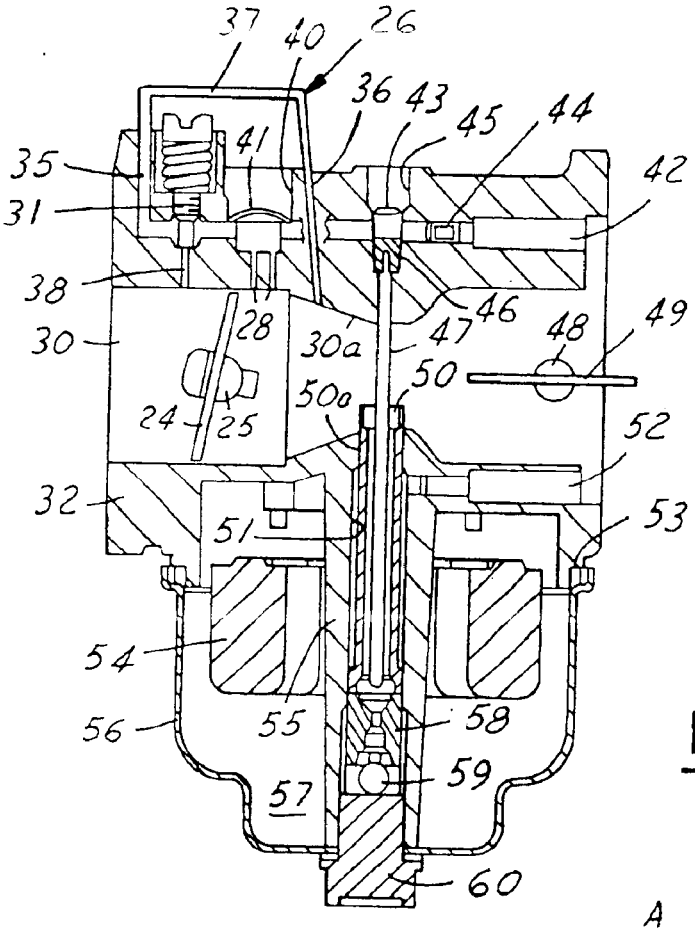
FIG. 9 is a side sectional view, showing an idle fuel supply device for a float type carburetor according to a fifth embodiment of the present invention.

In the embodiment shown in FIG. 9, for reasons of processing or machining a passage, the idle air passage 26 includes a passage 35 open to the end of the air passage 42 and to the upper wall of the carburetor body 32, a passage 36 open to the venturi portion 30*a* and to the upper end wall of the carburetor body 32, a conduit or pipe 37 connecting the passages 35 and 36, and a hole or passage 38 opening into the air intake passage 30. Fluid flow through the idle air passage 26 may be controlled by a needle valve 31. In FIG. 9, the needle valve 31 controls fluid flow through the passage 38 opening into the air intake passage 30. The other components of the carburetor of FIG. 9 may be similar to those shown in FIGS. 7 and 8, with similar function and effect are obtained.

The idle air passage provides an airflow, fuel in the fuel chamber is taken into the flow of air, and fuel is mixed with air in the idle air passage. Atomization of fuel is accelerated and fuel is taken into the air intake passage, because of which fuel does not collect on the inner peripheral wall of the air intake passage. Accordingly, atomized fuel is supplied to the engine via the air intake passage to provide stable idle operation of the engine.

What is claimed is:

1. A carburetor, comprising:

a body having an air intake passage and a fuel chamber formed therein, the fuel chamber being in communication with a supply of liquid fuel;

a throttle valve disposed at least in part in the air intake passage and being movable to and away from an idle position wherein the throttle valve controls at least in part the air flow through the air intake passage to support idle operation of an engine;

at least one low speed fuel nozzle communicating with a supply of liquid fuel and the air intake passage upstream of the throttle valve when the throttle valve is in its idle position; and a separate idle air passage formed in the body in communication at one end with the air intake passage upstream of the throttle valve at least when the throttle valve is in its idle position, the idle air passage communicates at its other end with the air intake passage downstream of the throttle valve at least when the throttle valve is in its idle position, and the idle air passage communicates with the fuel chamber between the ends of the idle air passage so that liquid fuel from the fuel chamber will be atomized in a flow of air in the idle air passage to discharge a fuel and air mixture from the idle air passage into the air intake passage downstream of the throttle valve when in its idle position and to the engine at least during idle operation of the engine.

2. The carburetor of claim 1 which also comprises a fuel metering chamber formed at least in part in the body, and wherein said supply of fuel is contained in the fuel metering chamber.

3. The carburetor of claim 1 which also comprises a needle valve disposed between said supply of fuel and the fuel chamber to control the flow of fuel to the fuel chamber.

4. The carburetor of claim 1 which also comprises a fuel nozzle hole formed in the body in communication with the air intake passage upstream of the throttle valve and with the fuel chamber so that fuel may enter the air intake passage upstream of the throttle valve during at least some operating conditions of the engine, and wherein fuel may enter the air intake passage downstream of the throttle valve from said other end of the idle air passage at least during idle operation of the engine.

5. The carburetor of claim 1 which also comprises a passage formed in the body communicating the fuel chamber with said supply of fuel and a fuel jet disposed in said passage through which fuel must flow prior to entering the fuel chamber.

6. The carburetor of claim 1 which also comprises a passage connecting the fuel chamber and the idle air passage, and a needle valve operably associated with said passage connecting the fuel chamber and the idle air passage to control fluid flow through said passage connecting the fuel chamber and the idle air passage.

7. The carburetor of claim 6 which also comprises a valve chamber of the needle valve and wherein the valve chamber communicates with the idle air passage so that the fuel chamber communicates with the idle air passage through the needle valve.

8. The carburetor of claim 1 which also comprises:

an air passage formed in the body in communication with the air intake passage and the idle air passage;

a fuel reservoir in which a supply of fuel is received; and a low speed fuel supply pipe in communication at one end with the supply of fuel in the fuel reservoir and at its other end with said air passage whereby fuel may flow from the fuel reservoir, through the low speed fuel supply pipe, to the air passage, to the idle air passage, and then into the air intake passage.

9. The carburetor of claim 8 which also comprises a needle valve in communication with the air passage such that fluid flow between the air passage and the idle air passage is controlled by the needle valve.

10. The carburetor of claim 9 which also comprises a passage communicating the air passage and the idle air passage and wherein a needle end of the needle valve is disposed at least in part in said passage to control fluid flow through said passage.

11. The carburetor of claim 8 which also comprises a needle valve in communication with the idle air passage such that fluid flow between the idle air passage and the air intake passage is controlled by the needle valve.

12. The carburetor of claim 1 wherein the throttle valve is a butterfly-type valve received for rotation in the air intake passage.

13. A carburetor, comprising:

a body having an air intake passage and a fuel chamber formed therein, the fuel chamber being in communication with a supply of fuel;

a throttle valve disposed at least in part in the air intake passage and being movable to and away from an idle position wherein the throttle valve controls at least in part the air flow through the air intake passage to support idle operation of an engine;

an idle air passage formed in the body in communication at one end with the air intake passage upstream of the throttle valve at least when the throttle valve is in its idle position and an choke valve when in its closed position, the idle air passage communicates at its other end with the air intake passage downstream of the throttle valve at least when the throttle valve is in its idle position, and the idle air passage communicates with the fuel chamber between the ends of the idle air passage so that liquid fuel from the fuel chamber will be atomized in a flow of air in the idle air passage to discharge a fuel and air mixture from the idle air passage into the air intake passage downstream of the throttle valve when in its idle position and to the engine at least during idle operation of the engine;

an air passage formed in the body in communication with the air intake passage and the idle air passage;

a fuel reservoir in which a supply of fuel is received; and a low speed fuel supply pipe in communication at one end with the fuel reservoir and at its other end with said air passage whereby fuel may flow from the fuel reservoir, through the low speed fuel supply pipe, to the air passage, to the idle air passage, and then into the air intake passage.

14. The carburetor of claim 13 which also comprises a needle valve in communication with the air passage such that fluid flow between the air passage and the idle air passage is controlled by the needle valve.

15. The carburetor of claim 14 which also comprises a passage communicating the air passage and the idle air passage and wherein a needle end of the needle valve is disposed at least in part in said passage to control fluid flow through said passage.

16. The carburetor of claim 13 which also comprises a needle valve in communication with the idle air passage such that fluid flow between the idle air passage and the air intake passage is controlled by the needle valve.

* * * * *